US008147213B2

(12) United States Patent
Hihn et al.

(10) Patent No.: US 8,147,213 B2
(45) Date of Patent: Apr. 3, 2012

(54) DEVICE FOR GUIDING POWDERY FLUIDIC MEDIA

(75) Inventors: Erwin Hihn, Walddorfhaeslach (DE); Apostolos Katefidis, Gaertringen (DE)

(73) Assignee: Eisenmann AG (DE)

( * ) Notice: Subject to any disclaimer, the term of this patent is extended or adjusted under 35 U.S.C. 154(b) by 1205 days.

(21) Appl. No.: 11/886,438

(22) PCT Filed: Mar. 6, 2006

(86) PCT No.: PCT/EP2006/002010

§ 371 (c)(1),
(2), (4) Date: Sep. 14, 2007

(87) PCT Pub. No.: WO2006/097211

PCT Pub. Date: Sep. 21, 2006

(65) Prior Publication Data

US 2009/0004028 A1 Jan. 1, 2009

(30) Foreign Application Priority Data

Mar. 18, 2005 (DE) ..... 10 2005 013 091

(51) Int. Cl.
*F04F 5/24* (2006.01)

(52) U.S. Cl. ..... 417/167; 417/76; 417/158; 417/168; 222/400.7; 239/112; 239/654

(58) Field of Classification Search ..... 417/182, 417/195, 198, 76, 77, 79, 80, 84, 158, 162, 417/166, 167, 168, 177, 185, 160, 163; 239/340, 239/112, 113, 654; 222/394, 398, 400.7
See application file for complete search history.

(56) References Cited

U.S. PATENT DOCUMENTS

| | | | | |
|---|---|---|---|---|
| 1,386,009 A | | 8/1921 | McDonald | |
| 1,566,517 A | * | 12/1925 | Bergman | 406/128 |
| 4,272,228 A | * | 6/1981 | Kutik et al. | 417/460 |
| 5,037,247 A | * | 8/1991 | Kaiser et al. | 406/153 |
| 5,429,304 A | | 7/1995 | Tomita et al. | |
| 6,149,395 A | * | 11/2000 | Richter | 417/182 |
| 6,155,752 A | * | 12/2000 | Buhlmann | 406/181 |
| 6,830,414 B2 | * | 12/2004 | Kia et al. | 406/138 |
| 2004/0251327 A1 | * | 12/2004 | Messerly et al. | 239/690.1 |
| 2005/0082395 A1 | * | 4/2005 | Gardega | 239/548 |

FOREIGN PATENT DOCUMENTS

| | | |
|---|---|---|
| DE | 43 34 082 B2 | 4/1994 |
| DE | 10250000 B3 | 4/2004 |
| FR | 2737980 A1 | 2/1997 |
| JP | 62279858 A1 | 12/1987 |
| LU | 28105 A1 | 8/1946 |

* cited by examiner

*Primary Examiner* — Devon C Kramer

*Assistant Examiner* — Leonard Weinstein

(74) *Attorney, Agent, or Firm* — Factor Intellectual Property Law Group, Ltd.

(57) ABSTRACT

A device for guiding powdery fluidic media, in particular powder paint, including a receptacle which is provided with an inner chamber for the media which is to be guided, and from where the medium is suctioned via a connection channel which can be closed by a valve body. The connection channel and the valve body comprise, respectively, an upper end area formed in such a manner that an annular Venturi nozzle is formed therebetween which is used as a pump. The valve body is inserted in a sealed manner in the end region of the connecting channel by a sealing section when in the closed position thereof and comprises a conveyor gas channel which can impinged upon by conveyor gas, through which the conveyor gas can be guided to the connection channel in the vicinity of the sealing section, essentially, in the direction of flow of the medium.

20 Claims, 1 Drawing Sheet

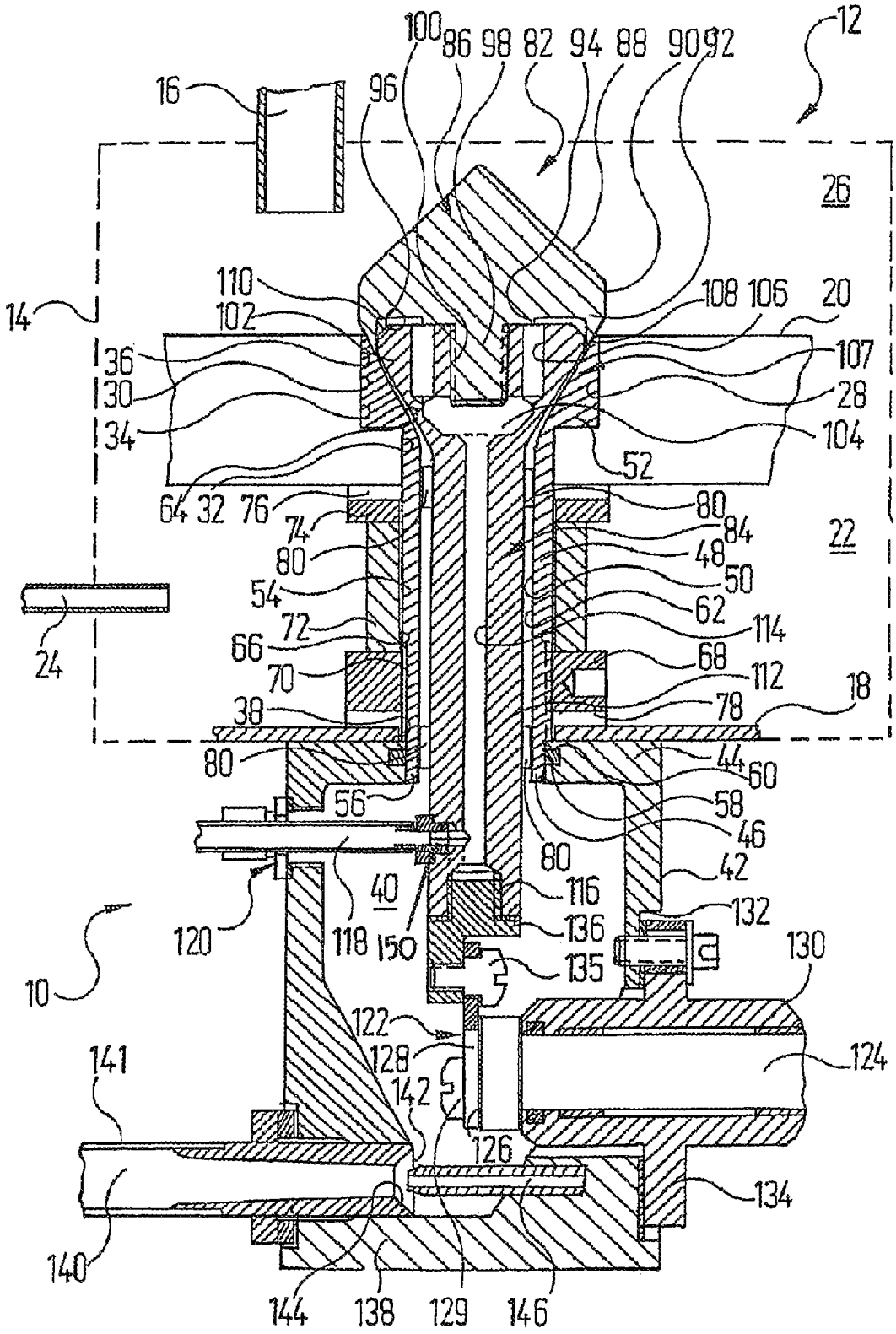
12
100
86
98
82
94
88
90
92
16
96
26
14
110
102
108
106
20
36
30
34
107
28
104
52
64
32
76
74
80
84
22
48
50
54
62
114
72
66
70
68
112
24
38
78
18
80
44
60
56
58
46
80
42
40
116
132
120
118
150
136
135
130
10
122
128
124
141
142
126
134
140
144
138
129
146

DEVICE FOR GUIDING POWDERY FLUIDIC MEDIA

RELATED APPLICATIONS

This application claims the filing benefit of International PCT Patent Application No. PCT/EP2006/002010, filed Mar. 6, 2006, which claims the filing benefit of German Patent Application No. 10 2005 013 091.7 filed Mar. 18, 2005, the contents of all these documents are incorporated herein by reference.

The present invention relates to a device for conveying powdery fluidic media, in particular a paint powder, comprising a receptacle with an inner chamber for the medium to be conveyed, and a pump which sucks the medium from the receptacle via a connecting channel which can be closed by a valve body.

BACKGROUND OF THE PRESENT INVENTION

Devices of this type are used, in particular, in surface technology, for example, of the automotive industry, for conveying paint powder to an application device, for example, a rotary atomiser. Different types of pumps can be used.

For example, a partial vacuum is generated by means of piston pumps known per se, whereby the paint powder fluidised in a receptacle is aspirated and conveyed to an atomiser in order to be applied thereby to an object, for example, a vehicle body.

In this case the paint powder is conveyed while being subjected to strong mechanical action, so that heating and abrasion of the individual powder particles, against either one another or the wall of the pump, cannot be completely avoided. This can result in an unwanted change in the particle size distribution of the paint powder. In addition, the abrasion can cause contamination of the pump or the powder conduits and even clogging of the entire plant.

Positive displacement pumps are also used for conveying powdery fluidized media. However, these pumps are less suited to paint powder because the paint powder tends to agglomerate when at rest and can therefore clog a positive displacement pump after a period of stoppage.

The susceptibility of such pumps to clogging with paint powder results partly from the fact that they have a relatively large number of comparatively small components which move quickly during operation of the pump, and which are spaced from one another, even if only by a small distance. A large number of gaps are therefore present in the flow path of the fluidized medium, in which gaps the medium may be deposited, impairing the operability of the pump and reducing the conveying capacity of the device.

The present invention is directed to addressing these and other concerns.

SUMMARY OF THE INVENTION

It is therefore an object of the present invention to provide a device of the type mentioned in the introduction which is less susceptible to malfunction.

This object may be achieved in that the connecting channel and the valve body have respective upper end regions which are so configured that an annular venture nozzle which acts as a pump is formed therebetween, and a sealing section of the valve body in the closed position thereof rests sealingly in the end region of the connecting channel, and the valve body includes a conveying gas channel which can be charged with conveying gas, through which the conveying gas can be supplied to the connecting channel in the vicinity of the sealing section substantially in the flow direction of the medium.

A pump is thereby produced which has no moving parts, apart from the valve body, and the pumping effect of which is achieved by the venturi nozzle. In addition, a conveying gas which generates a partial vacuum upon entering the venturi nozzle is blown through the conveying gas channel of the valve body. The partial vacuum sucks the fluidised medium from the receptacle when the valve body occupies its open position. If no further medium is to be sucked from the receptacle, the venturi nozzle can be sealed in a fluid-tight manner in that the valve body is moved to its closed position.

If the conveying gas can be supplied to the connecting channel downstream of the sealing section of the valve body, it is advantageously achieved that the conveying gas can be supplied to the connecting channel even when the valve body occupies its closed position and the flow path of the medium from the receptacle is blocked. In this way the entire region of the device downstream of the sealing section can be emptied almost completely of medium, without medium subsequently flowing from the receptacle.

The objective of producing the valve body in the most favourable manner possible is achieved in that said valve body comprises a valve stem and a head section mounted thereon. The valve body is thus simpler to produce, above all with regard to the conveying gas channel located in its interior.

To ensure uniform ingress of conveying gas into the annular venturi nozzle, the conveying gas channel of the valve body ends on its outlet side in an annular gap coaxial with the valve body.

It is advantageous with regard to production technology if the sealing section is in the form of a collar of the head section, which collar has an inner lateral surface which, together with an outer lateral surface of the upper end region of the valve stem disposed parallel to and radially inside said inner lateral surface, delimits the annular gap.

Clogging of the entrance gap of the annular venturi nozzle facing towards the inner chamber of the receptacle when the valve body occupies its closed position is simply prevented if the sealing section of the body is so arranged that, in the closed position of the valve body, it is in contact as far as the end of the connecting channel oriented towards the inner chamber of the receptacle. This means that, in the closed position of the valve body, no recess, in which powder might be deposited, remains between the sealing section and the end of the connecting channel. Such deposition might have the result that, upon reopening of the venturi nozzle, the ingress of medium from the receptacle into the connecting channel might initially be at least restricted.

The width of the entrance gap of the annular venturi nozzle is adjustable in a simple manner if the valve body is connected to a controllable lifting device.

To assist the conveyance of the medium by the suction effect of the annular venturi nozzle, it is helpful if an outlet of the device leading to an application device is configured in the manner of a venturi nozzle, a pressurized gas nozzle which can be charged with a conveying gas projecting into the entrance aperture of the outlet. In this way a supplementary suction effect is produced at the outlet of the device.

BRIEF DESCRIPTION OF THE DRAWINGS

One embodiment of a device according to the present invention is described in more detail with reference to a sole drawing. This single FIGURE shows a partial section through a device for conveying powdery fluidized media.

DETAILED DESCRIPTION OF THE PRESENT INVENTION

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The device 10 comprises a receptacle 12 with a housing 14, indicated schematically by a broken line, to which paint powder is supplied in a manner known per se via a conduit 16.

At a certain distance above its base 18, the receptacle 12 has a fluidizing base 20 of porous material. Compressed air is introduced via a line 24 into the pressure chamber 22 formed between the base 18 and the fluidizing base 20. Through the fluidizing base 20 the compressed air enters the inner chamber 26, located above the fluidised bed 20, of the receptacle 12 and fluidises the paint powder contained therein, so that the latter is flowable.

The fluidizing base 20 has a continuous stepped bore 28 with a first bore section 30 oriented towards the inner chamber 26 and a second bore section 32 oriented towards the pressure chamber 22. The second bore section 32 has a smaller diameter than the first bore section 30. The first bore section 30 of the stepped bore 28 extends into the fluidizing base 20 over somewhat more than half of the thickness thereof, and has an inner cylindrical region 34 and an outer conical region 36 widening in the direction of the inner chamber 26 of the receptacle 12, the angle of concinnity thereof being approximately 3°.

An opening 38 coaxial with the stepped bore 28 in the fluidizing base 20 is provided in the base 18 of the receptacle 12, the diameter of which opening 38 is slightly larger than that of the second bore section 32 of the stepped bore 28.

A housing 42 surrounding an inner chamber 40 is mounted below the base 18 of the receptacle 12, the upper face 44 of which housing 42 rests against the outer face of the base 18 of the receptacle 12. The housing 42 is so oriented that an opening 46 in its upper face 44, which opening 46 has a somewhat smaller diameter than the second bore section 32 of the stepped bore 28 in the fluidising base 20, is located coaxially with the opening 38 in the base 18 of the receptacle 12.

To connect the inner chamber 26 of the receptacle 12 to the inner chamber 40 of the housing 42, a connecting sleeve 48 with an axial through-bore 50 is provided. The connecting sleeve 48 has at its end a flange 52 complementary to the first bore section 30 of the stepped bore 28, which flange 52 is adjoined by a middle section 54. The external diameter of the latter corresponds to that of the second bore section 32 of the stepped bore 28. The middle section 54 adjoins an end section 56, the external diameter of which corresponds to that of the opening 46 of the housing 42. The connecting sleeve 48 can therefore be inserted with an exact fit into the stepped bore 28 in the fluidizing base 20, into the opening 38 of the base 18 of the receptacle 12 and into the opening 46 of the housing 42, as is shown in the FIGURE.

Sealing of the housing 42 with respect to the pressure chamber 22 of the receptacle 12 is effected by an O-ring 58 located in a groove 60 formed in the circumferential wall of the opening 46 of the housing 42, which O-ring 58 bears against the end section 56 of the connecting sleeve 48.

The through-bore 50 of the connecting sleeve 48 has a constant cross-section in a section 62 extending from the end section 56 to shortly before the region of the flange 52. The section 62 then merges into a section 64 which widens conically towards the top.

An external thread 66 is provided on the end of the middle section 54 of the connecting sleeve 48 oriented towards the base 18 of the receptacle 12. The connecting sleeve 48 is fixed by means of this thread 66 with respect to the fluidising base 20 of the receptacle 12. For this purpose a fixing ring 68 with a corresponding internal thread 70 is located on the external thread 66 of the connecting sleeve 48, a spacer bush 72, a damping ring 74 of elastic material and a washer 76 being arranged between the fixing ring 68 and the fluidizing base 20 and surrounding the connecting sleeve 48, as can be seen in the FIGURE.

By tightening the fixing ring 68 on the connecting sleeve 48, the latter is pulled in the direction of the base 18 of the receptacle 12 and is correspondingly fixed. For supplementary damping, a further damping ring 78 of elastic material is provided between the fixing ring 68 and the base 18 of the receptacle 12.

An axially displaceable valve body 82 passing through the through-bore 50 of the connecting sleeve 48 and axially displaceable therein, which valve body 82 is shown in the FIGURE in its closed position, is guided via ribs 80 formed integrally with the inner lateral surface of the section 62 of the bore 50 of the connecting sleeve 48. In its closed position the valve body 82 closes the flow path of the paint powder from the receptacle 12 to the inner chamber 40 of the housing 42.

The valve body 82 comprises a valve stem 84 and a head part 86 screwed therein. A cone 88, cylinder 90 and a collar 92, which merge into one another in one piece, form the outer lateral surface of the head part 86.

The cone 88 has an apex angle of approximately 90°. The cylinder 90 has a relatively short axial extension. The cross-section of the collar 92 corresponds to a right-angled triangle the hypotenuse of which forms the outer lateral surface of the collar 92, which tapers inwards towards the fluidising base 20. The cone angle of said collar 92 corresponds to the cone angle of the conical section 64 of the through-bore 50 of the connecting sleeve 48, so that the collar 92 of the head part 86 can rest with an exact fit in this section 64, as shown in the FIGURE. The collar 92 thus forms a sealing section of the valve body 82, which sealing section is in contact as far as the upper end of the connecting sleeve 48 when the valve body 82 occupies its closed position. Thus, in the closed position of the valve body 82, no recess, in which paint powder might be deposited, remains between the outer lateral surface of the collar 92 and the end of the conical section 64 of the through-bore 50 in the connecting sleeve 48 oriented towards the inner chamber 26 of the receptacle 12.

A cylindrical projection 94 is formed centrally and integrally on the lower (in the drawing) end face of the cylindrical section 90 of the head part 86, so that a circumferential groove 96 is formed between the collar 92 and the projection 94. The projection 94 in turn carries an integrally and centrally formed threaded pin 98 via which the head part 86 is screwed into a complementary threaded bore 100 in an air-distribution section 102 of the valve stem 84, which section 102 tapers conically inwards towards the bottom and cooperates with the head part 86.

The threaded bore 100 opens into an air-distribution chamber 104 of the valve stem 84. Passages 106 are provided at uniform angular intervals radially outside the threaded bore 100 and parallel to the axis thereof, which passages 106, like the threaded bore 100, start at the flat end face of the distribution section 102 and open into the air distribution chamber 104. With the head part 86 screwed in, the passages 106 communicate with the groove 96 of the head part 86.

The conical region of the outer lateral surface of the air distribution section 102 is disposed at a somewhat larger cone angle than the inner lateral surface of the conical section 64 of the through-bore 50.

The conical section 64 of the through-bore 50 of the connecting channel 48, and the air distribution section 102 of the valve body 82, thus form upper end regions respectively of the connecting channel 48 and of the valve body 82, which are so shaped that an annular venturi nozzle 107 is formed therebetween.

The groove 96 of the head part 86 merges radially towards the outside with an axial annular gap 108 between the inner lateral surface of the collar 92 and the valve stem 84. To achieve this, the outer cylindrical surface of the air distribution section 102 of the valve stem 84 is disposed, level with the collar 92 of the head part 86, at a distance of approximately 0.05 mm from and parallel to the inner lateral surface of the collar 92. The upper end (in the drawing) of the valve stem 84 has a radially circumferential chamfer 110 which serves to even out the air flow.

In the direction of the inner chamber 40 of the housing 42, a section 112 of constant cross-section which extends into the inner chamber 40 adjoins the air distribution section 102 of the valve stem 84.

The section 112 of the valve stem 84 has an axial bore 114 which at one end opens into the air distribution chamber 104 and at the other has an internal thread 116.

In the region of the section 112 of the valve stem 84 which is located in the inner chamber 40 of the housing 42, the wall of the section 112 has passing through it a bore 150 which opens perpendicularly into the axial bore 114 of said section 112. The bore 150 is connected in a fluid-tight manner to a flexible hose 118 which, sealed by means of a bulkhead fitting 120, passes through a side wall of the housing 42 and can be charged with compressed air.

As can be seen in the FIGURE, the annular gap 108 is connected, even in the closed position of the valve body illustrated, to the annular space which is formed between the outer lateral surface of the valve stem 82 and the inner lateral surface of the through-bore 50 of the connecting sleeve 48 and which opens into the inner chamber 40 of the housing 42.

The section 112 of the valve stem 84 is connected via the thread 116 to a lifting device 122. The latter includes a rotating shaft 124 passing through the side-wall of the housing 42. On the end face 126 of the shaft 124 located in the inner chamber 40 of the housing 42, one end of a connecting link 128 is mounted rotatably about a joint pin 129 disposed parallel to the axis of the rotating shaft 124. The joint pin 129 is therefore arranged eccentrically on the end face 126 of the rotating shaft 124.

The rotating shaft 124 runs in a shaft housing 130 which is fixed detachably to the housing 42. With the fixing released, the shaft housing 130 is displaceable in a direction parallel to the side-wall of the housing 42. For this purpose, the housing 42 has an opening 132 receiving the shaft housing 130, which opening 132 is somewhat larger than the portion of the shaft housing 130 located therein. The shaft housing 130 is mounted to the side-wall of the housing 42 via a circumferential fixing flange 134 provided with a sealing ring.

At its other end the connecting link 128 is connected rotatably, about a joint pin 135 disposed parallel to the axis of the rotating shaft 124, to a connecting piece 136, which is screwed via a complementary external thread into the threaded section 116 of the axial bore 114 of the valve stem 84.

The position of the shaft housing 130, and the angular position of the rotating shaft 124, are so selected that the joint pin 129 connecting the connecting link 122 to the rotating shaft 124 is at its shortest distance from the base 138 of the housing 42 when the valve body 82 occupies its (closed) position shown in the FIGURE.

A powder outlet 140, to which a hose 141 is attached, is provided a short distance above the base 138 of the housing 42. Said hose 141 leads to an application device (not shown). Behind the inlet opening 142 of the powder outlet 140 the inner lateral surface of the latter tapers initially relatively sharply inwards in the flow direction in the manner of a venturi nozzle in an initial portion 144, and then widens again substantially uniformly.

The inner face of the wall of the housing 42 through which the powder outlet 140 passes is flush with the inlet opening 142 of the powder outlet 140 and is inclined upwardly and outwardly from that point.

The tip of a compressed air nozzle 146 projects into the initial portion 144 of the powder outlet 140.

The above-described device 10 operates as follows:

The paint powder contained in the inner chamber 26 of the receptacle 12 is fluidized, as mentioned above, by the compressed air supplied to the pressure chamber 22 of the receptacle 12 and is thereby made flowable. The compressed air is supplied to the pressure chamber 22 at a pressure of not more than 2.0 bar, preferably from 0.25 to 0.5 bar.

The hose 118 is also charged with compressed air. On its flow path, this compressed air flows first through the axial bore 114 of the valve stem 84 into the air distribution chamber 104 thereof. From there it is distributed evenly through the passages 106 into the groove 96 between the valve stem 84 and the head part 86 of the valve body 82. Finally, the compressed air flows out of the axial annular gap 108 parallel to the axis of the valve body 82 into the space between the valve stem 84 and the connecting sleeve 48, and then into the inner chamber 40 of the housing 42.

If paint powder is now to be conveyed from the receptacle 12 to the application device, the valve body 82 is displaced in the direction of the inner chamber 26 of the receptacle 12, that is, upwards in the FIGURE. For this purpose, the rotary shaft 124 of the lifting device 122 is rotated by a servo motor (not shown). The connecting link 128 is thereby moved upwardly and the valve body 82 is displaced upwardly via the connecting piece 136.

The components are so adapted to one another that the maximum lift of the valve body 82 is approximately 4.0 mm; the actual lift depends in each case on the angular degree of rotation of the rotating shaft 124.

When an upward movement takes place the collar 92 of the head part 86 of the valve body 82 detaches itself from the inner lateral surface of the connecting sleeve 48, so that an annular access gap to the through-bore 50 of the connecting sleeve 48 is opened to the fluidized paint powder contained in the inner chamber 26 of the receptacle 12.

With the valve body 82 lifted, the compressed air emerging from the hose 118 enters the conical section 64 of the through bore 50 via a free length. In the region of the narrowest flow point a partial vacuum is generated according to the venturi principle, through which paint powder is actively drawn from the inner chamber 26 of the receptacle 12.

The rate of flow of the paint powder to be drawn from the receptacle 12 can be adjusted by the lift of the valve body 82. The smaller the lift and therefore the narrower the access gap between collar 92 of head part 86 and the connecting sleeve 48, the lower is the flow rate of the paint powder.

The fluidized paint powder supplied to the inner chamber 40 of the housing 42 is conducted by the air flow into the powder outlet 140. If necessary, air is blown through the compressed air nozzle 146 into the powder outlet 140 configured in the manner of a venturi nozzle. This additional introduction of air increases the conveying velocity of the paint powder and cleans the conveying channel.

If no further paint powder is to be drawn from the receptacle 12, the rotating shaft 124 is suitably rotated back, so that the valve body 82 is pulled down again to its closed position shown in the FIGURE. The collar 92 of the valve body 82 then again rests sealingly in the connecting sleeve 48 and no more paint powder can pass from the receptacle 12 into the inner chamber 40 of the housing 42.

Also in the closed position of the valve body 82, the conveying air emerging from the hose 118 continues to flow through the annular gap 108 into the connecting sleeve 48 and into the inner chamber 40 of the housing 42. The paint powder still present downstream of the sealing point of the valve body 82 is thereby conveyed completely out of the connecting sleeve 48 and the inner chamber 40 of the housing 42 into the powder outlet 140 and to the application device. The whole space below the collar 92 of the head part 86 of the valve body 82—in particular, the interior of the connecting sleeve 48 and the housing 42—is therefore always reliably emptied of paint powder.

The geometry of the head part 86 of the valve body 82 ensures that substantially no paint powder adheres to the outer lateral surface of the head part 86.

The invention claimed is:

1. A device for conveying powdery fluidized media, the device comprising:

a receptacle with an inner chamber for a powdery medium to be conveyed, the receptacle comprising a fluidizing base of porous material;

an introducing line below the fluidizing base through which a compressed gas is introduced in order to fluidize the powdery medium contained in the receptacle into the powdery fluidized medium;

a pump which sucks the powdery fluidized medium from the receptacle via a connecting channel which can be closed by a valve body;

an upper end region of the connecting channel and an upper end region of the valve body are configured so that an annular venturi nozzle which acts as the pump is formed therebetween;

wherein when the valve body is in a closed position, a sealing section of the valve body rests sealingly in the upper end region of the connecting channel, wherein the valve body includes a conveying gas channel which can be charged with a conveying gas, and the conveying gas can be supplied through the conveying gas channel to the connecting channel in a vicinity of the sealing section substantially in a flow direction the powdery fluidized medium flows in when the valve body is in an open position.

2. The device of claim 1, the conveying gas can flow into the connecting channel downstream of the sealing section of the valve body when the valve body is in the closed position.

3. The device of claim 1, wherein the valve body comprises a valve stem and a head section with the sealing section mounted on the head section.

4. The device of claim 1, wherein the conveying gas channel of the valve body ends on an outlet side of the conveying gas channel in an annular gap coaxial with the valve body.

5. The device of claim 4, wherein the valve body comprises a valve stem and a head section with the sealing section mounted on the head section, the sealing section is in the form of a collar of the head section, which collar has an inner lateral surface which, together with an outer lateral surface of an upper end region of the valve stem disposed parallel to and located radiantly inwards of said inner lateral surface, delimits the annular gap.

6. The device of claim 1, wherein the sealing section of the valve body is so arranged that, in the closed position of the valve body, the sealing section is in contact with a portion of the connecting channel that is located as far as an end of the connecting channel that is oriented towards the inner chamber of the receptacle.

7. The device of claim 1, wherein the valve body is connected to a controllable lifting device.

8. The device of claim 1, further comprising an outlet configured in a manner of a venturi nozzle, wherein the outlet leads to an application device, wherein a pressurized gas nozzle projects into an inlet opening of the outlet and can be charged with a second portion of conveying gas.

9. The device of claim 2, wherein the valve body comprises a valve stem and a head section with the sealing section mounted on the head section.

10. The device of claim 2, wherein the conveying gas channel of the valve body ends on an outlet side of the gas conveying channel in an annular gap coaxial with the valve body.

11. The device of claim 3, wherein the conveying gas channel of the valve body ends on an outlet side of the gas conveying channel in an annular gap coaxial with the valve body.

12. The device of claim 2, wherein the sealing section of the valve body is so arranged that, in the closed position of the valve body, the sealing section is in contact with a portion of the connecting channel that is located as far as an end of the connecting channel that is oriented towards the inner chamber of the receptacle.

13. The device of claim 2, wherein the valve body is connected to a controllable lifting device.

14. The device of claim 2, further comprising an outlet configured in a manner of a venturi nozzle, wherein the outlet leads to an application device, wherein a pressurized gas nozzle projects into an inlet opening of the outlet and can be charged with a second portion of conveying gas.

15. The device of claim 3, wherein the sealing section of the valve body is so arranged that, in the closed position of the valve body, the sealing section is in contact with a portion of the connecting channel that is located as far as an end of the connecting channel that is oriented towards the inner chamber of the receptacle.

16. The device of claim 3, wherein the valve body is connected to a controllable lifting device.

17. The device of claim 3, further comprising an outlet configured in a manner of a venturi nozzle, wherein the outlet leads to an application device, wherein a pressurized gas nozzle projects into an inlet opening of the outlet and can be charged with a second portion of conveying gas.

18. The device of claim 4, wherein the sealing section of the valve body is so arranged that, in the closed position of the valve body, the sealing section is in contact with a portion of the connecting channel that is located as far as an end of the connecting channel that is oriented towards the inner chamber of the receptacle.

19. The device of claim 4, wherein the valve body is connected to a controllable lifting device.

20. The device of claim 4, further comprising an outlet configured in a manner of a venturi nozzle, wherein the outlet leads to an application device, wherein a pressurized gas nozzle projects into an inlet opening of the outlet and can be charged with a second portion of conveying gas.

* * * * *